United States Patent [19]

Steiman

[11] 3,951,310

[45] Apr. 20, 1976

[54] SPRING-CHARGED AEROSOL DISPENSER

[75] Inventor: Wolf Steiman, Bridgeport, Conn.

[73] Assignee: V.C.A. Corporation, Greenwich, Conn.

[22] Filed: Feb. 11, 1974

[21] Appl. No.: 441,542

[52] U.S. Cl. ..... 222/95; 222/340

[51] Int. Cl.[2] ..... B65D 35/28

[58] Field of Search ..... 222/95, 340, 390

[56] References Cited

UNITED STATES PATENTS

| | | | |
|---|---|---|---|
| 1,235,550 | 8/1917 | Carmody | 222/95 X |
| 1,664,936 | 4/1928 | Lyman | 222/340 |
| 2,328,973 | 9/1943 | Goldfisher | 222/390 X |
| 3,273,760 | 9/1966 | Frankenberg | 222/95 X |
| 3,335,913 | 8/1967 | Bouet | 222/95 |
| 3,616,970 | 11/1971 | Baumann et al. | 222/390 X |
| 3,830,410 | 8/1974 | Magrath et al. | 222/309 |

FOREIGN PATENTS OR APPLICATIONS

| | | | |
|---|---|---|---|
| 1,179,121 | 12/1958 | France | 222/95 |
| 906,341 | 5/1945 | France | 222/390 |

*Primary Examiner*—Robert B. Reeves
*Assistant Examiner*—Frederick R. Handren
*Attorney, Agent, or Firm*—H. Gibner Lehmann; K. Gibner Lehmann; E. Donald Mays

[57] ABSTRACT

An aerosol dispenser of the hand-held type, comprising a can which contains a flexible, collapsible bag having the substance to be discharged. A valve on the can communicates with the bag to effect the discharge. In the can a spring engages a wall portion of the bag, tending to collapse the same, and there are manually operable means including a finger piece for varying the force applied by the spring to the bag as the contents of the latter are gradually depleted whereby the rate of discharge of the spray can be maintained more nearly constant regardless of the quantity of substance occupying the bag at any particular time.

2 Claims, 8 Drawing Figures

SPRING-CHARGED AEROSOL DISPENSER

BACKGROUND

This invention relates generally to hand-held aerosol spray devices, and more particularly to devices of this type employing an inner collapsible bag containing substance to be discharged and a can or outer casing constituting a housing, wherein a spring disposed in the casing is employed to press against a wall portion of the bag and thus pressurize the same. Such a device is disclosed in U.S. Pat. No. 3,335,913, and employs a spring-biased bellows, a valve communicating therewith and a discharge button or actuator. In this construction, the compressive force exerted by the spring on the bellows is greatest when the dispenser is full. As the contents are gradually exhausted, the spring expands causing successively greater collapse of the bag. Under such circumstances, the force exerted by the spring is reduced considerably as the bag contents become depleted. This leads to a reduction in pressure in the bag, resulting in a lower velocity spray discharge through the valve. It has been found that such a reduction in pressure is objectionable in that the characteristics of the spray depend largely upon the degree of depletion of the container contents. Attempts to alter the spring compression for satisfactory performance at either the full or the empty condition of the dispenser have represented at best a compromise solution to the above problem. In addition, in many prior constructions employing bellows-type flexible containers, it has not been possible to dispense the last portion of substance, since the bellows could undergo only limited compression. As a result, there was almost always some residual liquid which could not be dispensed and which was thus wasted when the dispenser was discarded.

SUMMARY

The above drawbacks and disadvantages of prior, collapsible bag type hand-held aerosol dispensers are obviated by the present invention, which has for an object the provision of a novel and improved spray dispenser as above set forth which is simple in construction, reliable in operation and which has the unusual characteristic of providing a much more uniform spray velocity over its entire life. A related object is to provide a dispenser as above wherein the residual fluid which remains in the dispenser and which cannot be discharged is greatly minimized, resulting in substantially reduced product waste.

The above objects are accomplished by an aerosol spray dispenser comprising a product-carrying collapsible bag carried in an outer casing or can, a valve projecting from the casing and communicating with the bag, a spring disposed in the casing for applying pressure to a wall portion of the bag so as to pressurize the same, the externally engageable manually operable means for periodically restoring the force applied by the spring to the bag as the contents of the latter are depleted. Such an arrangement enables the bag to have a much more constant internal pressure, independent of the amount of substance which occupies the bag at any particular time. As a result, the spray characteristic of the discharge is more uniform and has a substantially constant velocity throughout the life of the dispenser, regardless of the degree of depletion of the contents.

Other features and advantages will hereinafter appear.

In the drawings, illustrating several embodiments of the invention:

Figure 1:
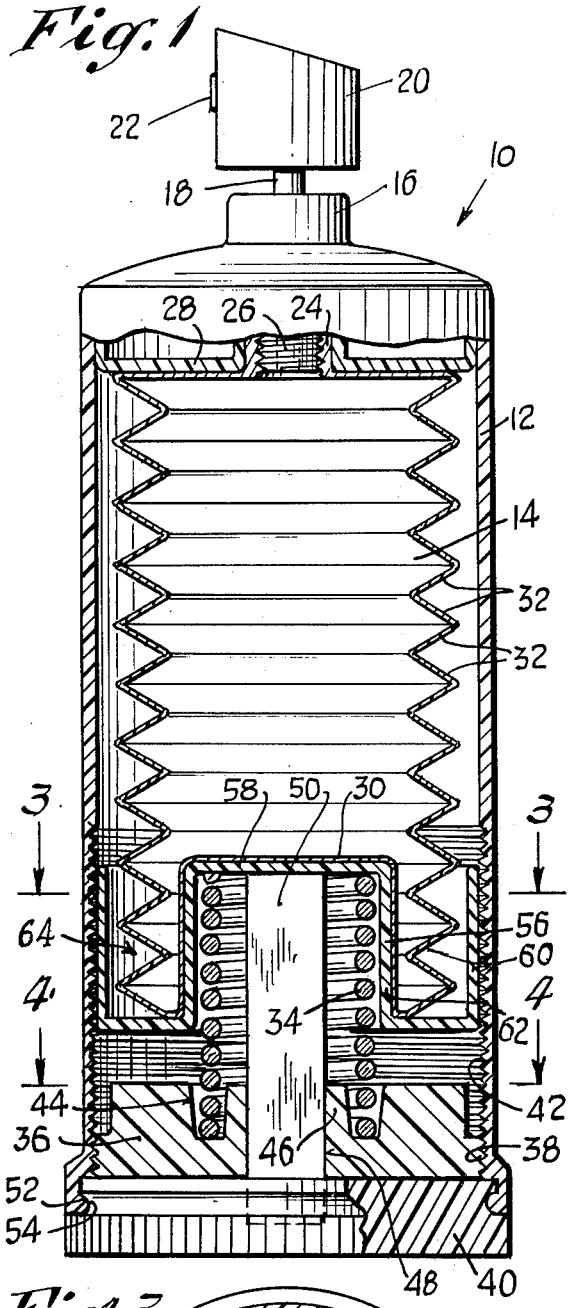
FIG. 1 is a vertical sectional view of the improved aerosol spray dispenser of the present invention shown in the fully charged position before any dispensing has occurred.
Figure 2:
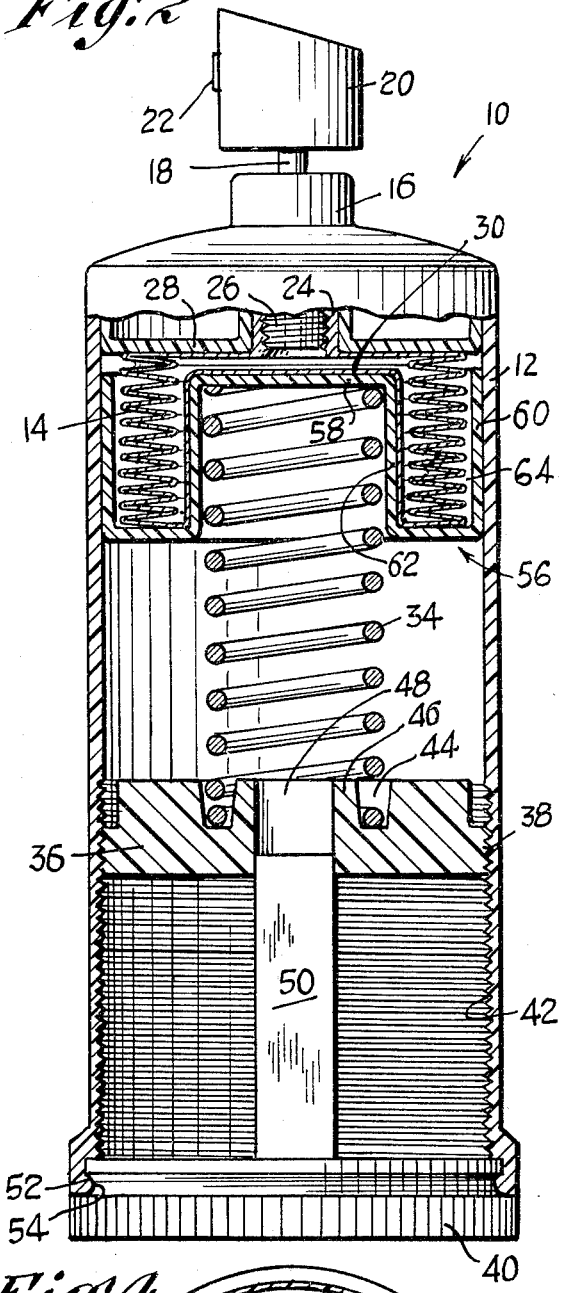
FIG. 2 is a view like FIG. 1 except illustrating the dispenser in a fully depleted condition, wherein virtually all of the fluid substance has been exhausted from the dispenser.

Referring to FIGS. 1 and 2 there is provided an aerosol spray dispenser generally designated by the numeral 10, comprising an outer casing or housing 12, a collapsible bag 14 disposed in the housing, and a valve 16 including a valve stem 18. The stem carries a depress button 20 having a discharge nozzle 22 all in the usual manner. The bag has a neck portion 24 which is secured to a hollow depending boss 26 of the valve 16 by means of cooperable screw threads. Alternately, other suitable fastening means could be employed such as a press fit between the neck 24 and the boss 26. A centralizing and support ring 28 maintains the neck 24 in a fixed position in the casing, in which case the valve 16 could merely protrude through the casing top wall without being rigidly fastened thereon. The bag 14 is shown as having the form of a bellows with a movable wall 30 and a plurality of folded portions 32, and is adapted to confine a quantity of fluid substance to be dispensed through the valve in a conventional manner.

In accordance with the present invention there is provided a novel means for pressurizing the collapsible bag 14 and for effecting adjustment of said pressure by externally adjustable manually operable means, such that as the substance in the bag is gradually depleted, the pressure therein can be controlled to thus provide an especially uniform spray characteristic over the entire life of the dispenser. In accomplishing this, there is provided a spring 34 which engages the movable wall 30 of the collapsible bag (through a support cup to be described below), a follower member 36, and an externally engageable finger piece 40 which is turnably carried by the casing. The inner surface of the casing has a cylindrical threaded portion 42, the threads of which mate with the threads 38 of the follower member 36. The member also has an annular groove 44 and a raised central portion 46 which provides a firm seat for one end of the spring 34 as shown in FIG. 1. In addition, the member 36 has a centrally disposed keying aperture 48 which receives an upstanding post 50 carried by the finger piece 40. There is a sliding fit between the post 50 and the walls of the aperture 48 such that the follower member 36 can be advanced with respect to the casing as turning movement is imparted to it by the finger piece. The latter is turnably mounted in the casing and held captive therein by means of cooperable shoulders 52, 54 which are snapped past one another during assembly.

Figure 3:
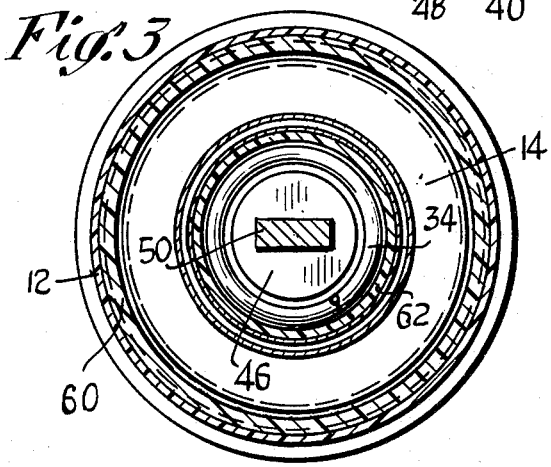
FIG. 3 is a section taken on line 3—3 of FIG. 1.
Figure 4:
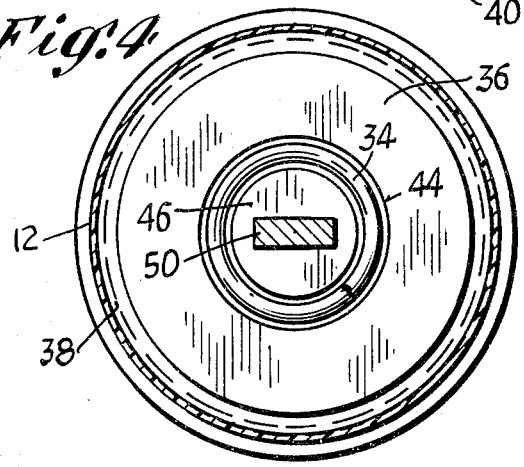
FIG. 4 is a section taken on line 4—4 of FIG. 1.
Figure 5:
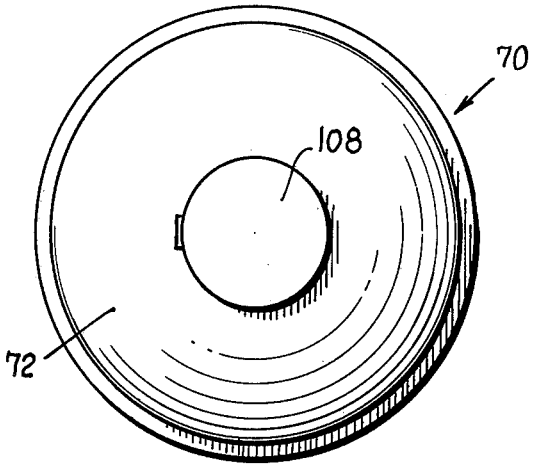
FIG. 5 is a top plan view of a modified aerosol dispenser, constituting another embodiment of the invention.
Figure 6:
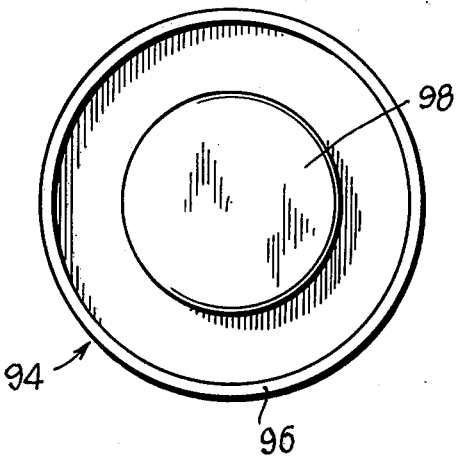
FIG. 6 is a bottom plan view of a support cup part as employed in the modified dispenser of FIG. 5.
Figure 7:
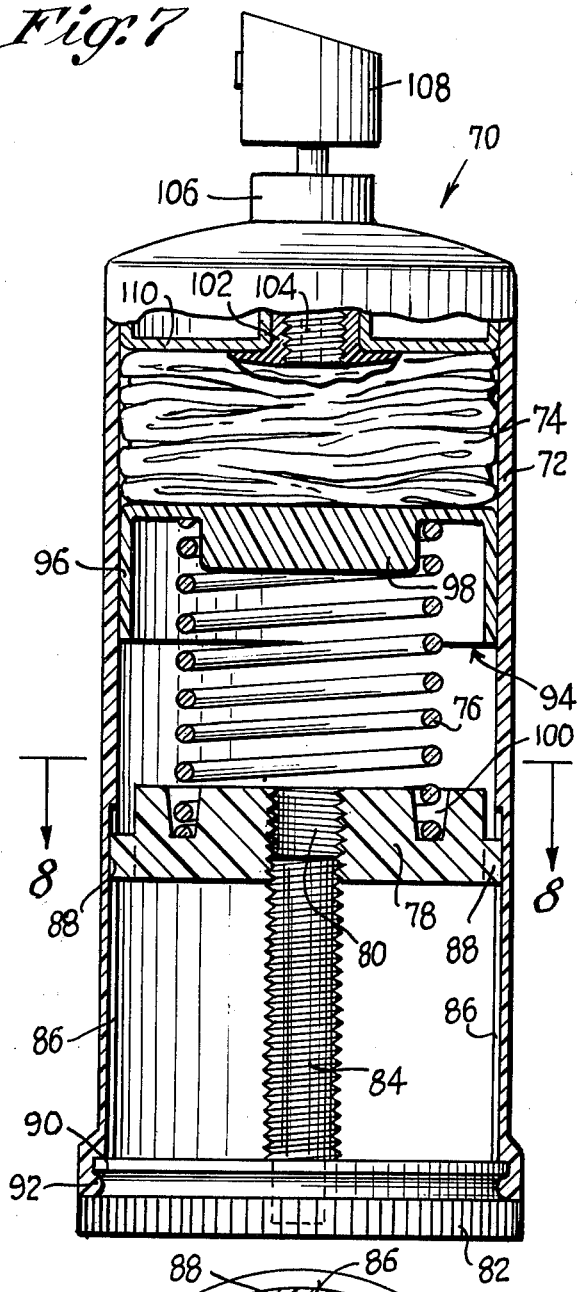
FIG. 7 is a vertical sectional view of the dispenser of FIG. 5, shown in its fully depleted condition.
Figure 8:
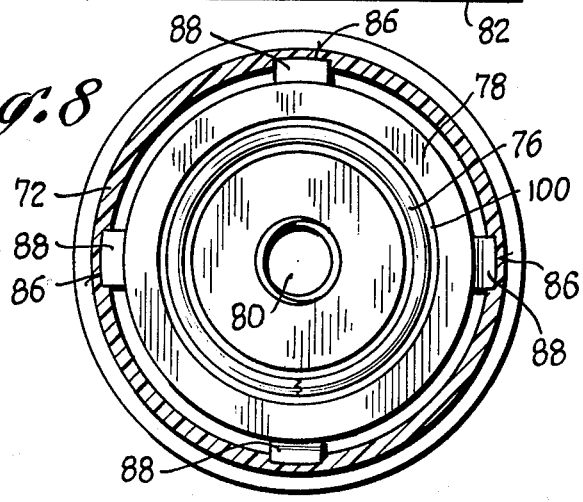
FIG. 8 is a section taken on line 8—8 of FIG. 7.

Referring to FIGS. 1–3, by the present invention there is provided an inverted support cap 56 having a bottom wall 58 and a pair of spaced-apart annular walls 60, 62 defining an annular channel 64. The channel receives some of the folded portions 32 of the bellows so as to confine them during the upward movement of the wall 30 in FIG. 1. This wall, together with the adjacent annular side wall portion, define a recess which receives the cup 56 and one end of the spring 34. In addition to providing a seat for the spring, this arrangement facilitates more complete emptying of the bellows than would otherwise be possible. This is apparent from FIG. 2 wherein the bellows has been almost completely collapsed, and the wall 30 is closely adjacent the neck 24. As a result, more complete emptying is realized and less waste of liquid product occurs when the exhausted dispenser is discarded.

In a fully charged dispenser, the bellows 14, spring 34 and follower member 36 have the relative positions illustrated in FIG. 1. The spring is under a predetermined compression sufficient to provide a satisfactory discharge when the valve 16 is actuated. As the contents of the bellows become depleted, the spring will expand, reducing the force applied to the wall 30 and decreasing the pressure within the bellows. In order to compensate for this pressure reduction which occurs during normal use, the operator merely turns the finger piece 40, thus advancing the follower 36 in FIG. 1 and restoring the compression of the spring. Such an arrangement provides a more constant and uniform spray characteristic than would be possible if the spring were held stationary and merely allowed to expand as the bellows emptied. As a result, a greatly improved discharge results, since the variation in spray velocity over a period of time is negligible, even when the contents of the dispenser are near depletion. To my knowledge, until the present invention, no prior device has successfully solved this problem.

Further rotation of the finger piece 40 from the position of FIG. 2 will result in additional advancing movement of the follower member 36 until the latter becomes separated from the post 50. Such an arrangement can be advantageously employed to indicate to the user that the dispenser is approaching the fully depleted condition. This separation will be evidenced by a substantially decreased drag force opposing the turning of the finger piece, and can be readily sensed by the user.

Another embodiment of the invention is illustrated in FIGS. 5–8, showing an aerosol dispenser 70 having an outer casing 72, a flexible, collapsible bag 74 adapted to carry liquid to be dipensed and which can undergo random folding or crumpling as the liquid is depleted, a spring 76 applying a force to a wall portion of the bag so as to pressurize the contents of the latter, and a grooved follower member 78 for increasing the force of the spring on the bag as the contents thereof are gradually depleted. The follower member 78 has a centrally disposed aperture 80 which is internally threaded. A manually engageable finger piece 82 carries a threaded upstanding post 84 which extends through and engages the threaded wall of the aperture 80. The arrangement is such that as the finger piece is turned, the follower 78 undergoes advancing movement in an axial direction with respect to the casing. The member is prevented from turning by a plurality of longitudinal grooves 86 which are molded on the inside of the casing and which receive corresponding ribs 88 on the member periphery. As in the previous embodiment, the finger piece 82 is turnably carried on the casing by cooperable shoulders 90, 92 on the casing and piece, respectively.

Disposed between the spring 76 and bag 74 is an inverted support cup 94 which is slidable in an axial direction along the inside of the casing. An expansive annular wall 96 minimizes tilting and possible binding of the cup as it moves. The cup has a central plateau 98 which provides a seat for one end of the spring 76, the other end being received in an annular groove 100 in one face of the follower member 78.

The operation of this embodiment is similar to that of the dispenser illustrated in FIGS. 1–4. The spring 76 initially pressurizes the bag 74 to a level providing satisfactory spray characteristics. As the contents are gradually depleted (and the spray velocity is reduced), the user merely turns the finger piece 82 one or two turns at a time. This advances the follower member 78 which in turn restores the force of the spring on the bag and reestablishes a higher pressure therein. It will be seen that as the cup 94 advances, the bag undergoes a random, non-uniform folding, such that the volume therein gradually diminishes. This construction is seen to have the advantage of low cost, while at the same time providing virtually complete emptying of the dispenser.

The bag 74 has a neck 102 which is fastened to the hollow boss 104 of a valve 106, all in the usual manner. The valve stem carries a depress button 108 for effecting selective actuation of the valve and discharge of the dispenser contents. An annular supporting ring 110 functions in a manner identical to the ring 28 in FIG. 1.

From the above it can be seen that I have provided a novel and improved aerosol dispenser which is simple in construction, reliable in operation and which effectively overcomes the problem of non-uniform spray which has been characteristic of all prior collapsible bag-type dispensers to date. In addition, the construction is seen to provide virtually complete emptying of the dispenser whereby waste of product is significantly reduced. The dispenser is thus seen to represent a significant advance and improvement in aerosol dispenser technology.

Variations and modifications are possible without departing from the spirit of the invention.

I claim:

1. A spray dispenser of the hand-held type comprising in combination:

a. a casing having a generally cylindrical sidewall and being open at the lower end thereof and having internal threads on the lower portion thereof, and a non-removable top wall fixedly attached to the upper end of said sidewall, said top wall providing a central opening therein;

b. a discharge valve structure having a manually operable actuator protruding from said central opening in said top wall, and a boss extending downwardly from said top wall;

c. means rigidly mounting said valve structure in proximity to said top wall;

d. a collapsible, flexible bag having its upper end attached to said boss of said valve structure and having a movable wall adapted to reduce the volume of said bag so as to expell the contents of said bag through said valve;

e. an inverted support cup slidably received in said casing supporting said movable wall of said flexible bag, said cup having spaced apart outer and inner cylindrical walls connected at their lower ends by an annular bottom wall, said inner cylindrical wall being closed at its upper end by a flat top wall to provide an axially aligned cup-shaped recess;

f. spring means within said casing having its upper end received in said cup-shaped recess;

g. a follower member having an annular recess in its upper surface receiving the lower end of said spring, said member having external threads engageable with the internal threads of said sidewall to enable advancing movement of said follower member in response to turning thereof with respect to said casing;

h. an external finger piece closing the opening in said casing;

i. means rotatably mounting said finger piece on the lower end of said casing; and j. keying means connecting said finger piece and said follower member for effecting axial movement of said follower member within said casing.

2. A spray dispenser of the hand-held type comprising in combination:

a. a casing having a generally cylindrical sidewall and being open at the lower end thereof and a non-removable top wall fixedly attached to the upper end of said sidewall, said top wall providing a central opening therein;

b. a discharge valve structure having a manually operable actuator protruding from said central opening in said top wall, and a boss extending downwardly from said top wall;

c. means rigidly mounting said valve structure in proximity to said top wall;

d. a collapsible, flexible bag having its upper end attached to said boss of said valve structure and having a movable wall adapted to reduce the volume of said bag so as to expell the contents of said bag through said valve;

e. spring means within said casing acting on said movable wall, tending to shift the same so as to reduce the volume of said collapsible wall bag;

f. manually operable means for increasing the force on the spring means on the movable wall, said means including closing means for closing the open end of said casing, said closing means being mounted for rotation with respect to said casing;

g. said valve mounting means including a centralizing and support ring rigidly mounted within said casing adjacent said top wall; and h. said centralizing and support ring having a central opening therein receiving said boss and said upper end of said flexible bag in a close supporting fit.

* * * * *